US010681963B1

(12) United States Patent
Rowland et al.

(10) Patent No.: US 10,681,963 B1
(45) Date of Patent: Jun. 16, 2020

(54) BELT BUCKLE SYSTEM WITH SET SCREW SYSTEM

(71) Applicants: Edward Rowland, Alta Loma, CA (US); Tom Hunsucker, Alta Loma, CA (US)

(72) Inventors: Edward Rowland, Alta Loma, CA (US); Tom Hunsucker, Alta Loma, CA (US)

( * ) Notice: Subject to any disclaimer, the term of this patent is extended or adjusted under 35 U.S.C. 154(b) by 0 days.

(21) Appl. No.: 16/231,549

(22) Filed: Dec. 23, 2018

Related U.S. Application Data

(60) Provisional application No. 62/780,280, filed on Dec. 16, 2018.

(51) Int. Cl.
*A44B 11/12* (2006.01)
*A44B 11/00* (2006.01)

(52) U.S. Cl.
CPC ..... *A44B 11/006* (2013.01); *A44B 11/12* (2013.01)

(58) Field of Classification Search
CPC ..... A44B 11/12; A44B 11/24; A44B 11/006; A44B 11/065
See application file for complete search history.

(56) References Cited

U.S. PATENT DOCUMENTS

| | | | | |
|---|---|---|---|---|
| 749,995 | A * | 1/1904 | Johnson | Y10T 24/4098 |
| 3,466,668 | A * | 9/1969 | Ochiai | A44B 11/12 2/322 |
| 5,572,747 | A * | 11/1996 | Cheng | A44B 11/12 2/312 |
| 6,067,662 | A * | 5/2000 | Sim | A44B 11/14 2/322 |
| 8,689,364 | B2 * | 4/2014 | Rowland | A41F 9/025 2/311 |
| 9,277,776 | B2 * | 3/2016 | Laatz | A44B 11/125 |
| 2014/0259545 | A1 * | 9/2014 | King | A44B 11/006 24/170 |
| 2015/0342306 | A1 * | 12/2015 | Chen | A44B 11/006 24/185 |

* cited by examiner

*Primary Examiner* — Tajash D Patel

(57) ABSTRACT

Clothing belt adjustment systems are configured for wearing around a user's body such as around the waist. The belt adjustment system includes a belt and a buckle wherein the belt can be looped and secured to the buckle to secure the belt around a user's waist or other portion of the body. The buckle has a body with a thin side profile that is not overly bulky such that it can comfortably fit over the button region of a wearer's pants. The buckle advantageously includes one or more threaded retainer members, such as threaded screws, that secure one portion of the buckle to another portion of the buckle. The buckle includes at least one set screw that further secures the belt member to the buckle.

14 Claims, 10 Drawing Sheets

BELT BUCKLE SYSTEM WITH SET SCREW SYSTEM

REFERENCE TO PRIORITY DOCUMENT

This application claims priority to U.S. Provisional Application Ser. No. 62/780,280 entitled "Belt Buckle System with Set Screw System" filed on Dec. 16, 2018. Priority is claimed to the aforementioned filing date and the provisional application is incorporated herein by reference in its entirety.

BACKGROUND

Conventional belt buckles or belt adjustment systems are limited in their ability to conform to a particular user's waist size. Belt adjustment systems conventionally secure a belt about a user's waist by relying on a series of spaced holes punched through an end of a belt. A hook of a belt buckle can be inserted through a hole to capture the end of the belt to secure the belt in a loop of a particular size. The spacing between each of the holes as well as the overall number of holes can vary for adjustment of belt size but is generally limited by the minimal material that must remain between the holes.

Conventional belt adjustment systems are limited to setting the size of the belt loop to discrete sizes based upon the spacing of the holes in the belt. If a user desires to set the belt to a loop size that is positioned between the holes in the belt, the user has to manually create an additional hole in the belt, which can be difficult and unattractive if not performed well. Alternately, the user must use the next smaller or next larger belt loop size relative to the desired size, which can be uncomfortable for the user.

To deal with these drawbacks, there are pinless belt buckle systems that use a ratcheting belt buckle that is removably attached to a belt. The buckle includes a clamp that clamps onto one end of the belt. However, the clamp and belt attachment can undergo strong forces during use, which can often cause the belt to come undone and release from the clamp. In view of this, there is a need for improved belt buckle systems that have more reliable clamping onto a belt.

SUMMARY

Disclosed is an improved belt buckle system that removably clamps onto a belt with a secure clamping mechanism.

In one aspect, there is disclosed a belt system, comprising: an elongate belt member comprising a first end, a second end and an inner surface near the second end, wherein the inner surface has a series of teeth; and a buckle system removably attached on a first end of the belt member, including a ratchet assembly that engages the series of teeth on the belt member, the buckle including a clamp mechanism that clamps onto the first end of the belt member to secure the belt member to the buckle system, the buckle system further including at least one set screw that further secures the belt member to the buckle system.

Other features and advantages should be apparent from the following description of various embodiments, which illustrate, by way of example, the principles of the claimed subject matter.

BRIEF DESCRIPTION OF THE DRAWINGS

These and other aspects will now be described in detail with reference to the following drawings.

DETAILED DESCRIPTION

Before the present subject matter is further described, it is to be understood that this subject matter described herein is not limited to particular embodiments described, as such may of course vary. It is also to be understood that the terminology used herein is for the purpose of describing particular embodiments only and is not intended to be limiting. Unless defined otherwise, all technical terms used herein have the same meaning as commonly understood by one skilled in the art to which this subject matter belongs.

Figure 1:
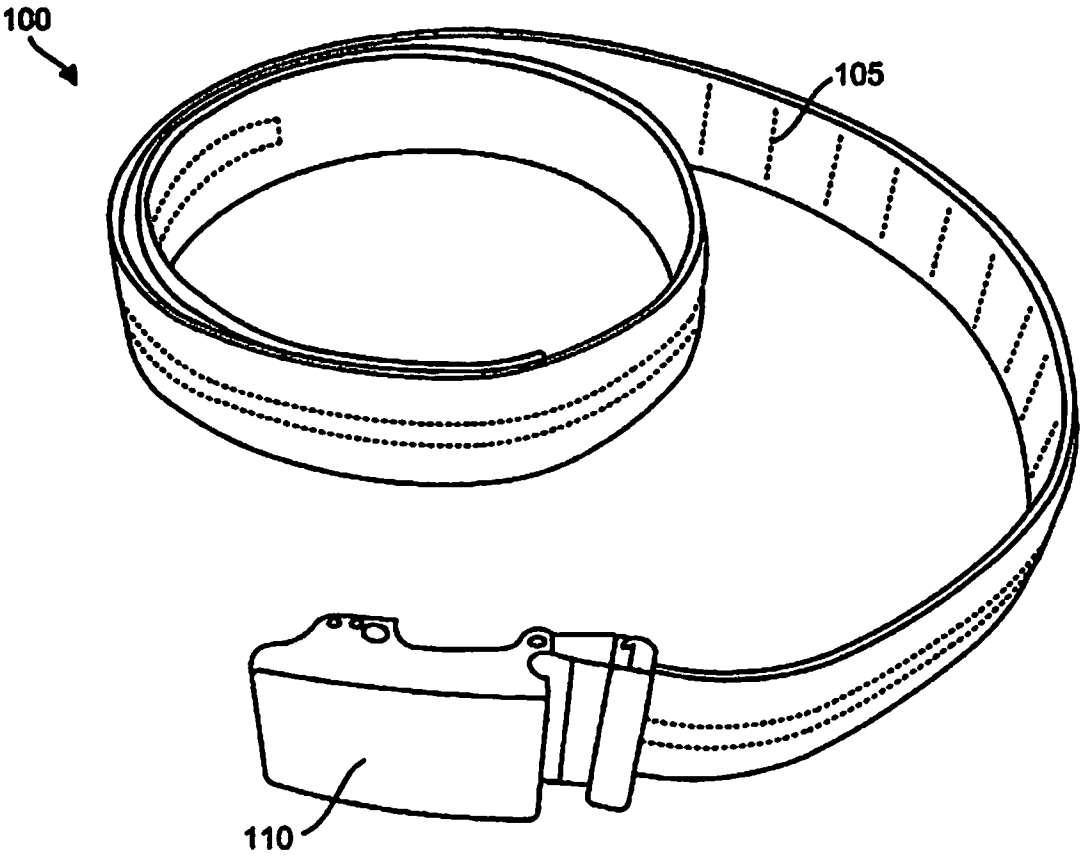
FIG. 1 shows a schematic view of an embodiment of a belt system.

FIG. 1 shows a perspective view of an embodiment of a belt system 100 that may be worn with a pair of pants, shorts, trousers, skirts or other articles of clothing. The system 100 can also be used with other items such as watch straps, purse straps, guitar straps or animal collars or other articles that may include a buckle system that is adjusted for size or where a number of size variations would be desirable. Some figures include exemplary numerical dimensions. It should be appreciated that the dimensions are for example only and are not intended to be limiting. The belt buckle system can be configured with dimensions outside of the ranges and values shown.

The belt system 100 includes an elongated belt 105 and a buckle 110 disposed on a first end of the belt 105. The buckle 110 is removably attached to the belt such as by using a clamp on the buckle 110. The belt buckle 110 is a pinless buckle in that it does not use a pin to secure itself to the belt 105 when the belt is looped around a user's waist. The belt buckle 105 has a front face that faces away from a user or a user's torso when the belt is worn around the user's waist. That is, the belt buckle 105 sits flat against the user's waist or torso such that the buckle will be positioned over the region of the user's pants where a button is typically located on the user's pants.

In an example embodiment, the belt 105 is coupled to a holster that is sized and shaped to hold a firearm, such as a pistol or gun.

Figure 2:
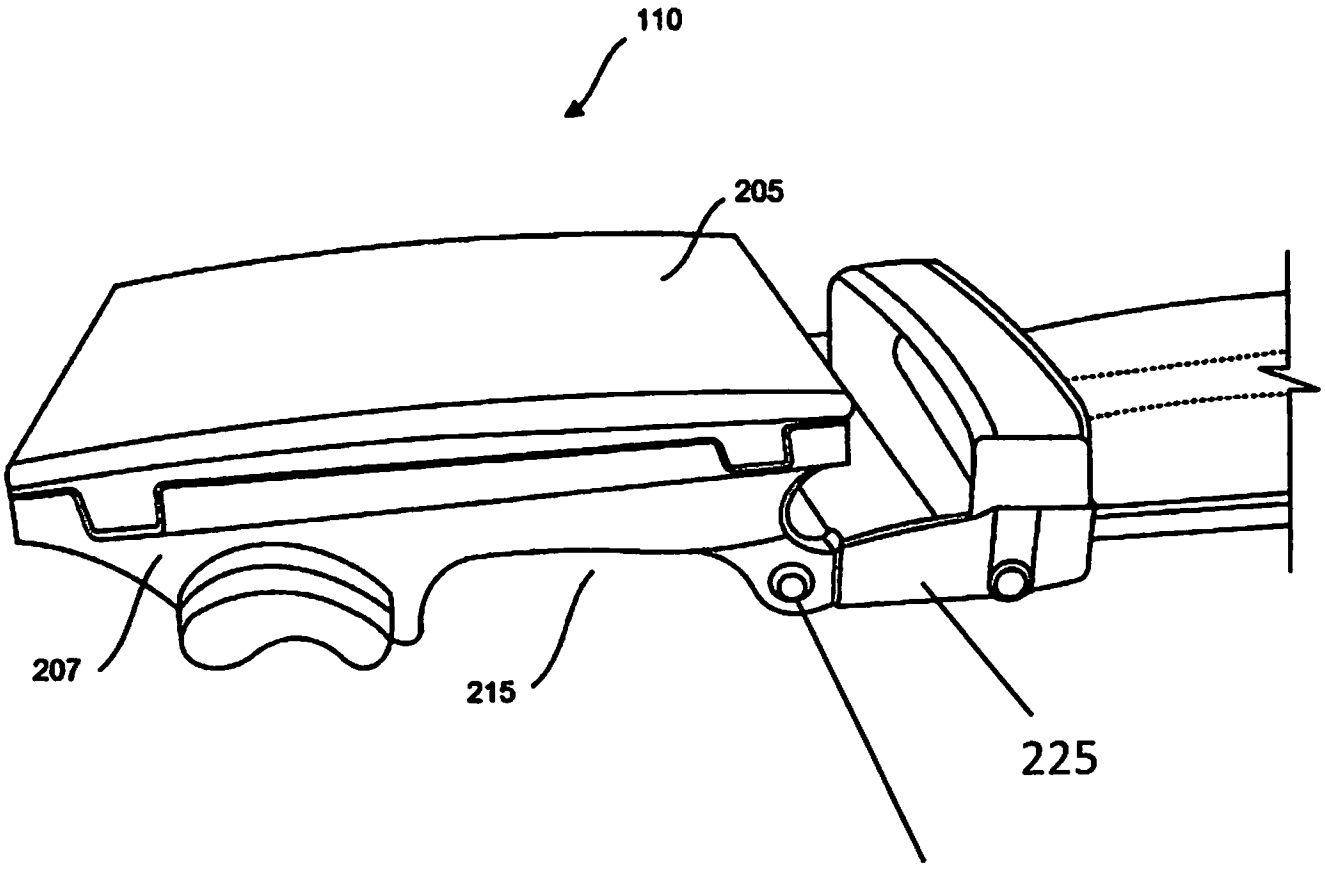
FIG. 2 shows a perspective, side view of a belt buckle of the belt system.
Figure 3:
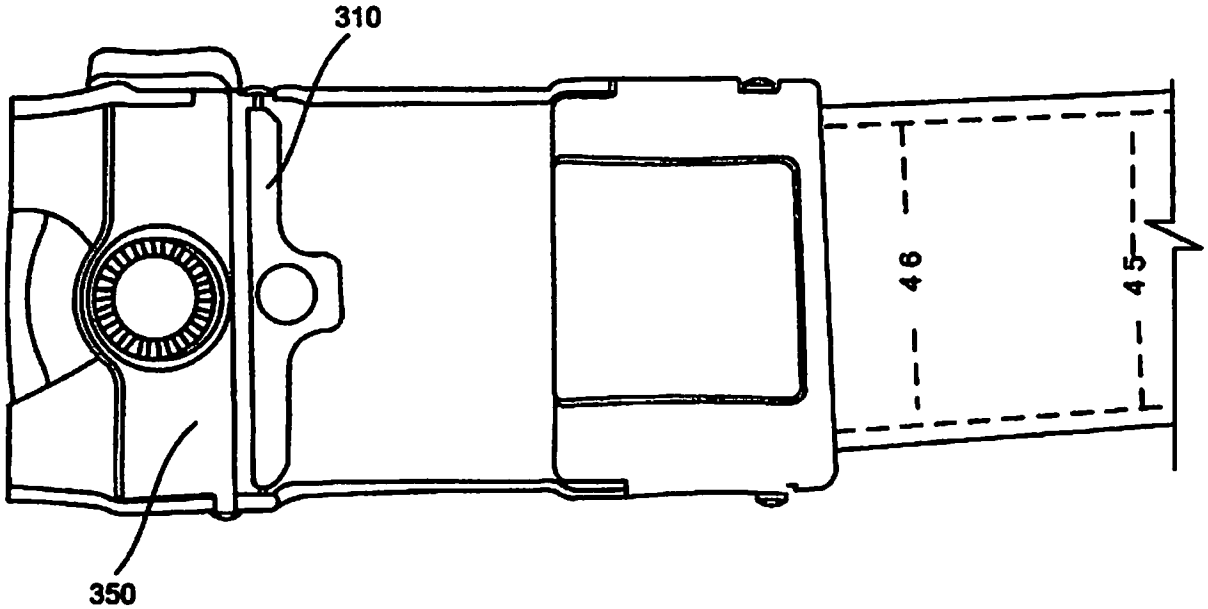
FIG. 3 shows a bottom view of the belt buckle.
Figure 4:
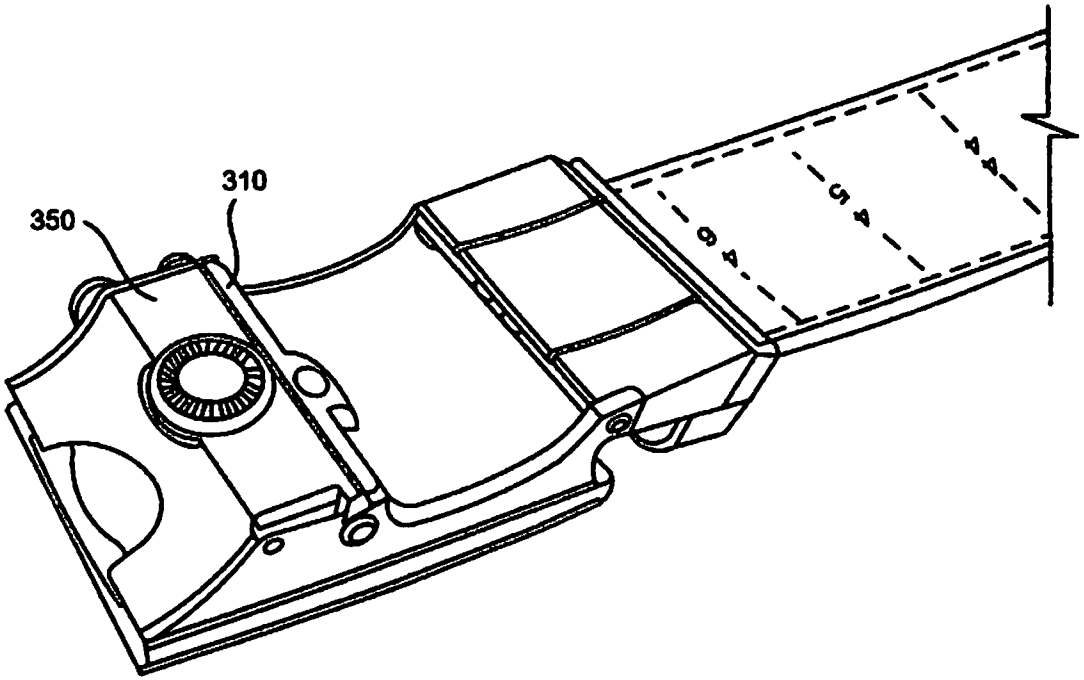
FIG. 4 shows a bottom view of the belt buckle.

FIG. 2 shows a perspective, side view of the belt buckle 110. FIGS. 3 and 4 show bottom views of the belt buckle 110. The belt buckle 110 has a front face that can be formed by a door 205 or other movable portion. The door 205 is movable relative to a body 207 of the belt buckle such that the door 205 can be opened (such as in a pivoting manner) relative to the body to expose an internal chamber, as described in more detail below. A belt loop structure 225 is attached to a main body of the buckle 110 such as at one or more attachment locations 230. In an embodiment, the belt loop structure 225 can pivot or rotate about an axis that intersects the attachment location 230. In addition, as described more fully below, at least one threaded member, such as a threaded screw, extends through the belt loop structure 225 and the main body of the buckle 110 to secure the belt loop structure 225 to the main body.

With reference to FIGS. 3 and 4, the buckle 110 has a bridge 350 that forms or at least partially defines an opening through which the opposite end of the belt can be threaded when worn by a user. A movable latch 310 or other pinless member is configures to move towards and engage with a portion of the opposite end region of the belt when the opposite region is positioned through the opening formed by the bridge 350 for securing the belt to the buckle in a desired position. In an embodiment, the latch 310 secures to a tooth or other engagement portion formed within a row of engagement portions on the belt. The latch 310 can be biased toward a latching engagement with the belt such as by using a biasing member, which can be, for example, a magnet, a spring, or other device.

As mentioned above with reference to FIG. 2, at least one threaded member, such as a threaded screw, extends through the belt loop structure 225 and the main body of the buckle 110 to secure the belt loop structure 225 to the main body. A threaded member such as a threaded screw can also be used to secure other portions of the buckle 110 to one another. For example, a threaded screw can be used to secure the bridge 350 to the main body of the buckle. This is different and more secure than using a non-threaded pin to secure the buckle portions to one another. A non-threaded pin has a tendency to loosen from the buckle such that the buckle can become unstable or fall apart at some point during use.

Figure 5:
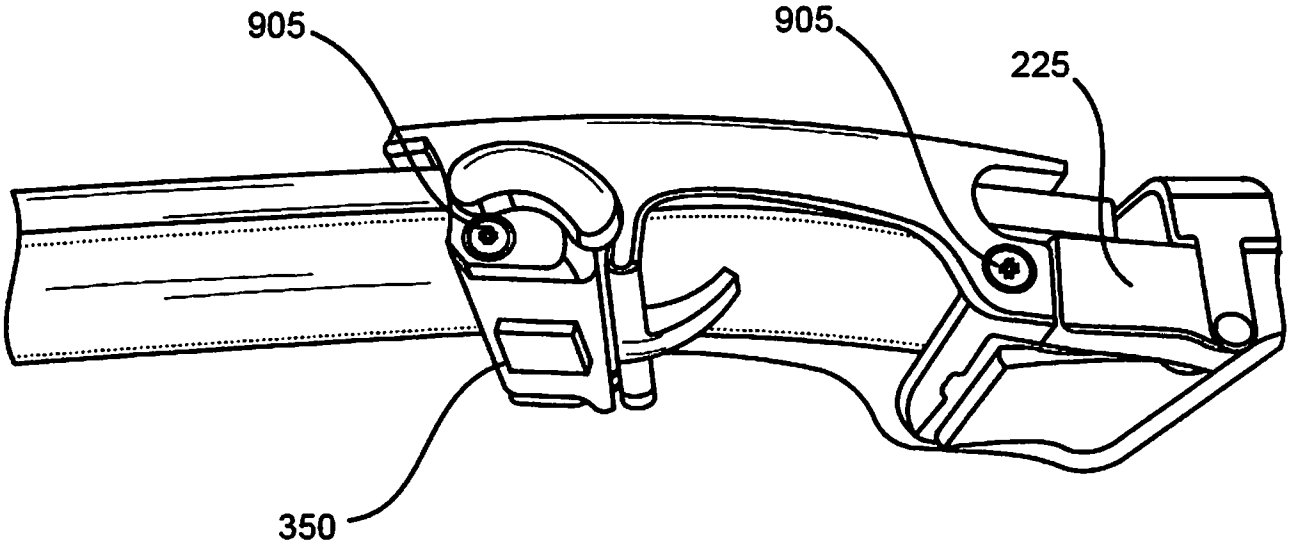
FIG. 5 shows a side view of the buckle with threaded retainer members.

FIG. 5 shows a side view of the belt buckle. One or more threaded members, such as threaded screws 905, secure portions of the belt buckle to one another. For example, threaded screws 905 secure the bridge 350 and/or the belt loop structure 225 to the main body of the belt buckle. In this regard, one or more aligned, threaded openings or passageways can extend through the bridge 350 and the main body. A screw 905 can be threadedly positioned in the aligned passageways to secure the components of the buckle to one another via the screw 905. It should be appreciated that threaded screws can be used to secure other portions of the buckle to one another. In addition, the threaded screw can have various types of heads, such as Allen heads, for attaching to a drive member, such as an Allen wrench.

The threaded screw 905 is an elongated body such a cylindrical body having a head on a proximal end and threads on an external surface of a distal region of the body or over the entire body. The head portion of the screw may be enlarged in diameter relative to a remainder portion of the screw or may have the same diameter as the remainder portion of the screw. The screw 905 is an externally threaded fastener capable of being inserted into holes in any portion of the buckle for securing a first component of the buckle to any other component or components of the buckle. The screw is capable of mating with a preformed internal thread or forming its own thread within the respective hole, and of being tightened or released by torqueing the head. In an example embodiment, the screw has a diameter in the head and/or body portion of 3 mm. In another embodiment, the screw has a diameter of 1-2 mm or 1-3 mm.

It should be appreciated that threaded screws are much more secure than pins or other types of non-threaded structures. The threaded screws can withstand forces that the buckle undergoes during use. The buckle can experience high levels of torque and linear forces, which can cause the buckle to come apart or otherwise malfunction. The threaded screws 905 eliminate or greatly reduce the likelihood that the belt buckle will come apart as a result of such forces.

Figure 6:
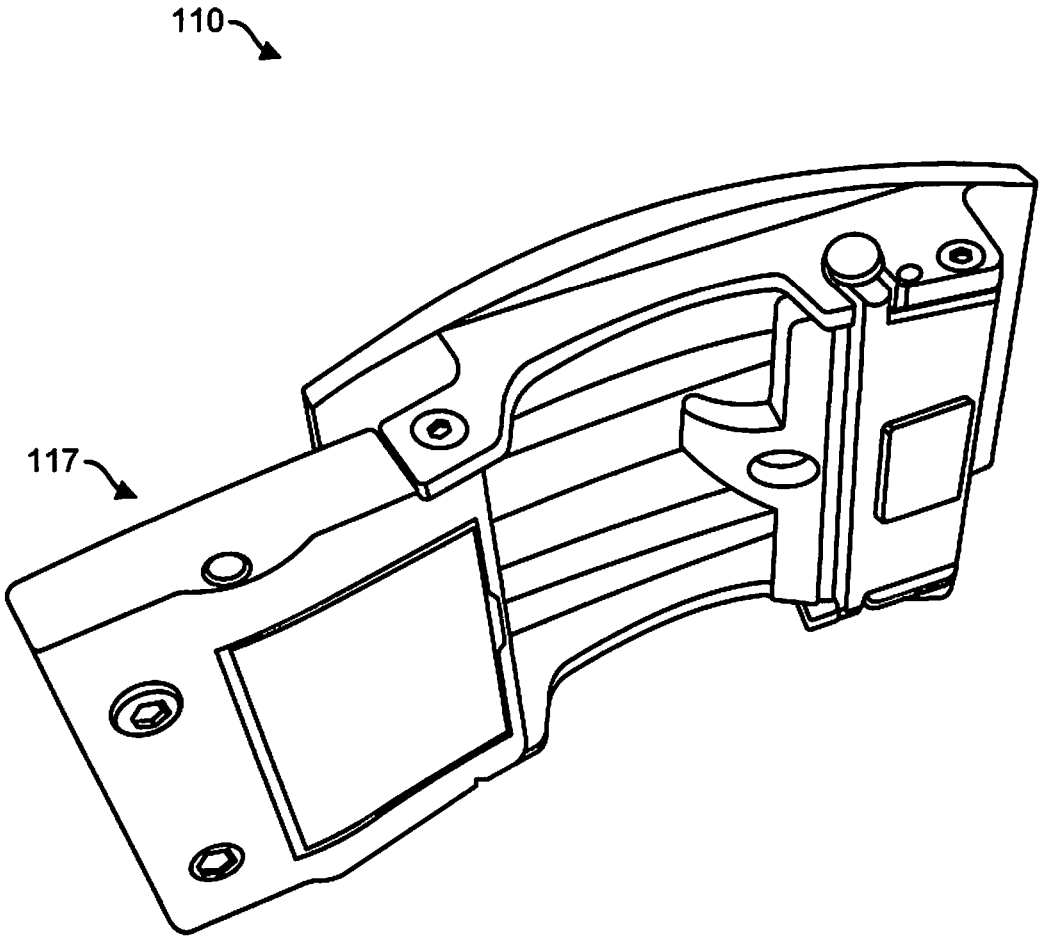
FIG. 6 shows an alternate embodiment of a belt buckle 110.
Figure 7:
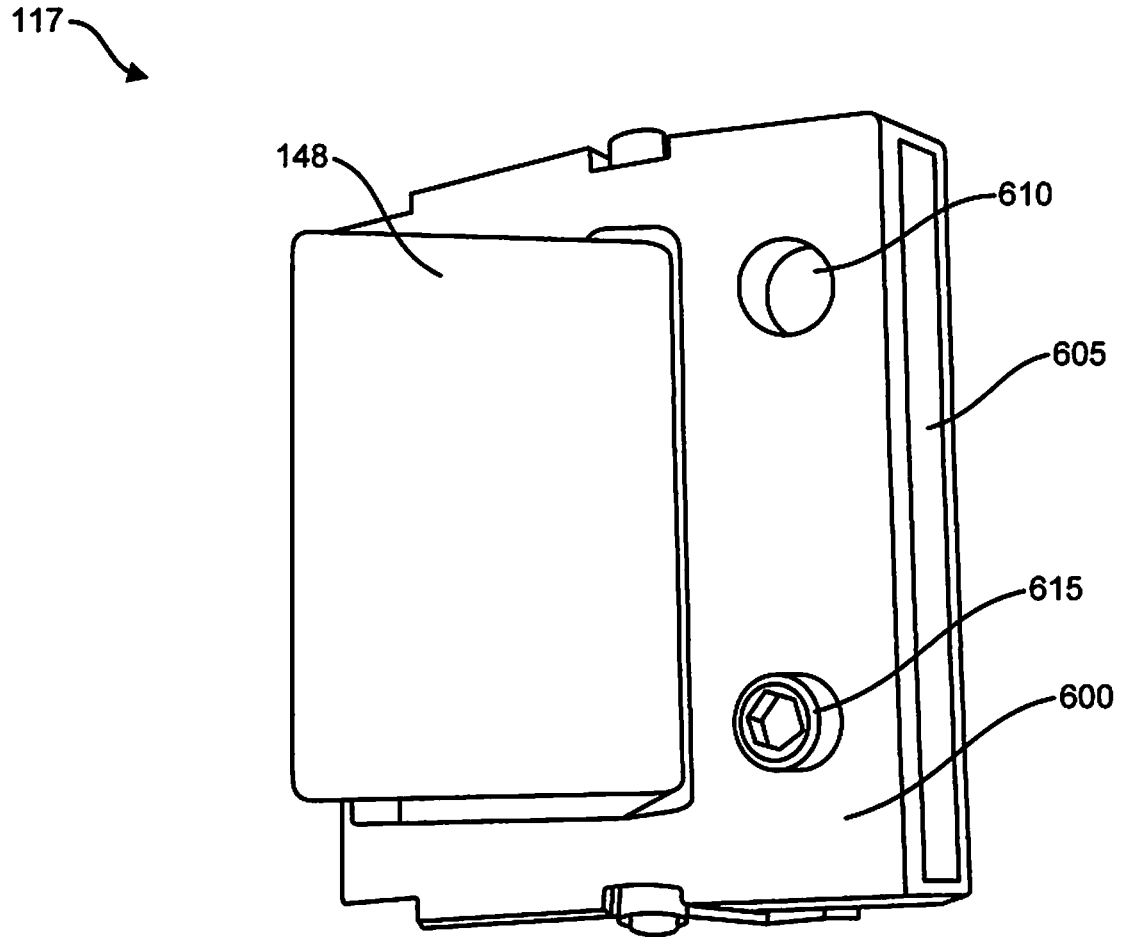
FIGS. 7 through 10 shows a clamp mechanism of the belt buckle of FIG. 6.
Figure 8:
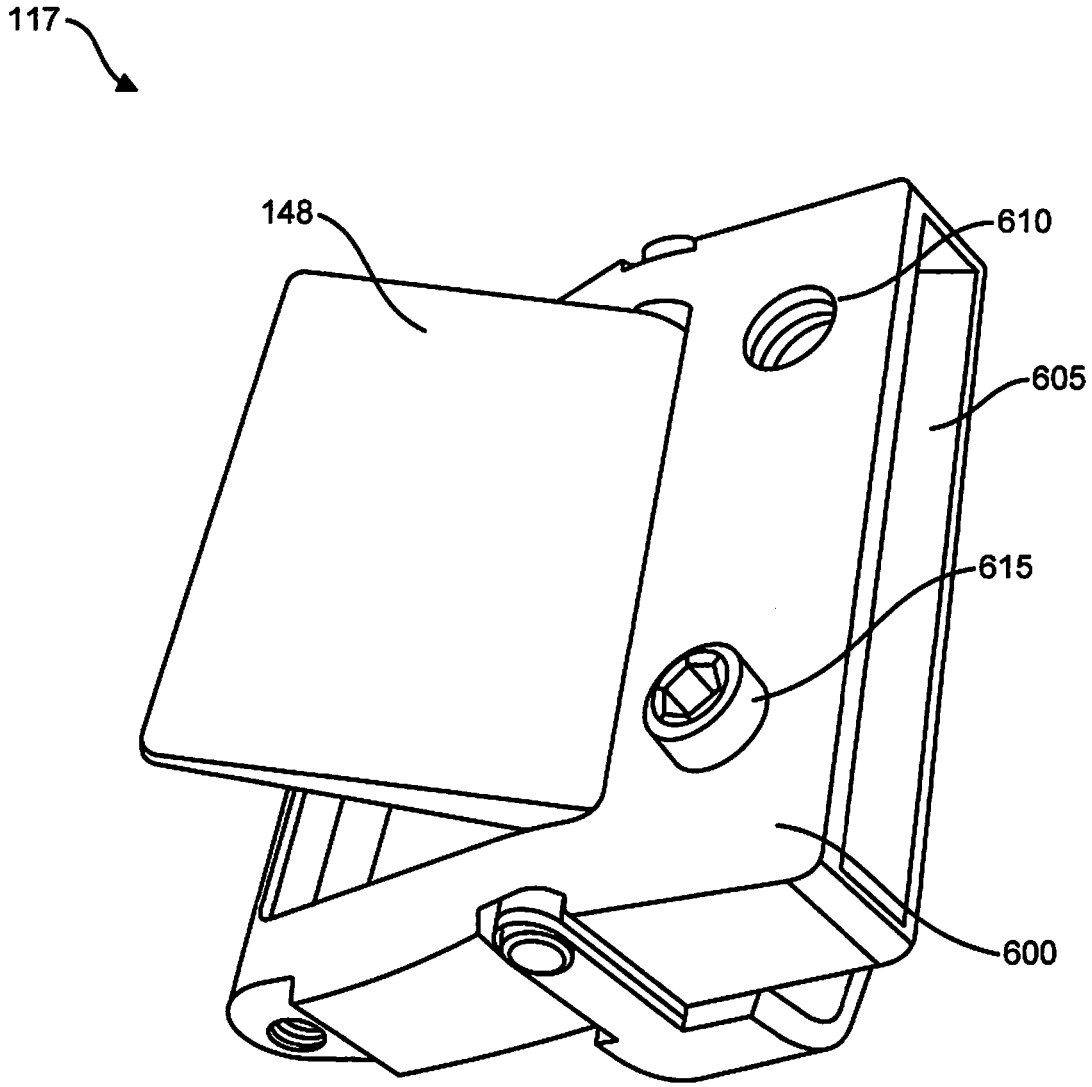

FIG. 6 shows an alternate embodiment of a belt buckle 110. The belt buckle 110 of FIG. 6 has an alternate clamping mechanism 117 that is configured to clamp onto the belt to secure it to the buckle 110. The buckles shown in FIGS. 1 and 6 can have any of the features described with respect to either of the buckles.

FIGS. 7-10 show the clamp mechanism 117 of the buckle of FIG. 6. The clamp mechanism 117 is formed of a main body 600 that defines a slot-shaped mouth or opening 605 that communicates with a belt passageway sized to receive an end or end region of the belt. As mentioned, the clamp mechanism can clamp onto the end of the belt to keep it retained within the buckle. One or more threaded bores 610 are positioned through the body 600 and communicate with the belt passageway of the opening 605. A threaded screw 615 can be threadedly positioned into each bore 610 such that an end of the screw 615 inserts into the belt passageway in a manner that can engage or otherwise contact the belt when the belt is positioned in the passageway. The type of screw can vary. In an embodiment, the screw is an Allen screw with a distal end that is pointed or otherwise shaped to increase the likelihood that the distal end of the screw can insert into or otherwise engage the belt.

Figure 9:
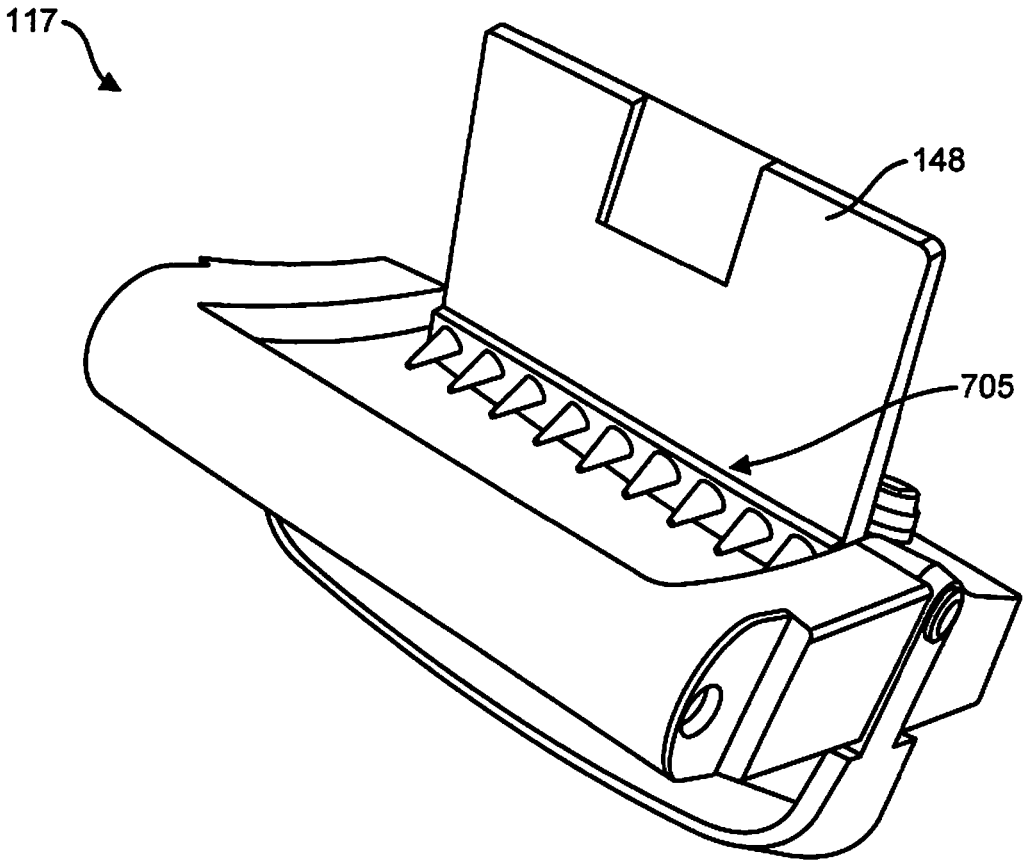
Figure 10:
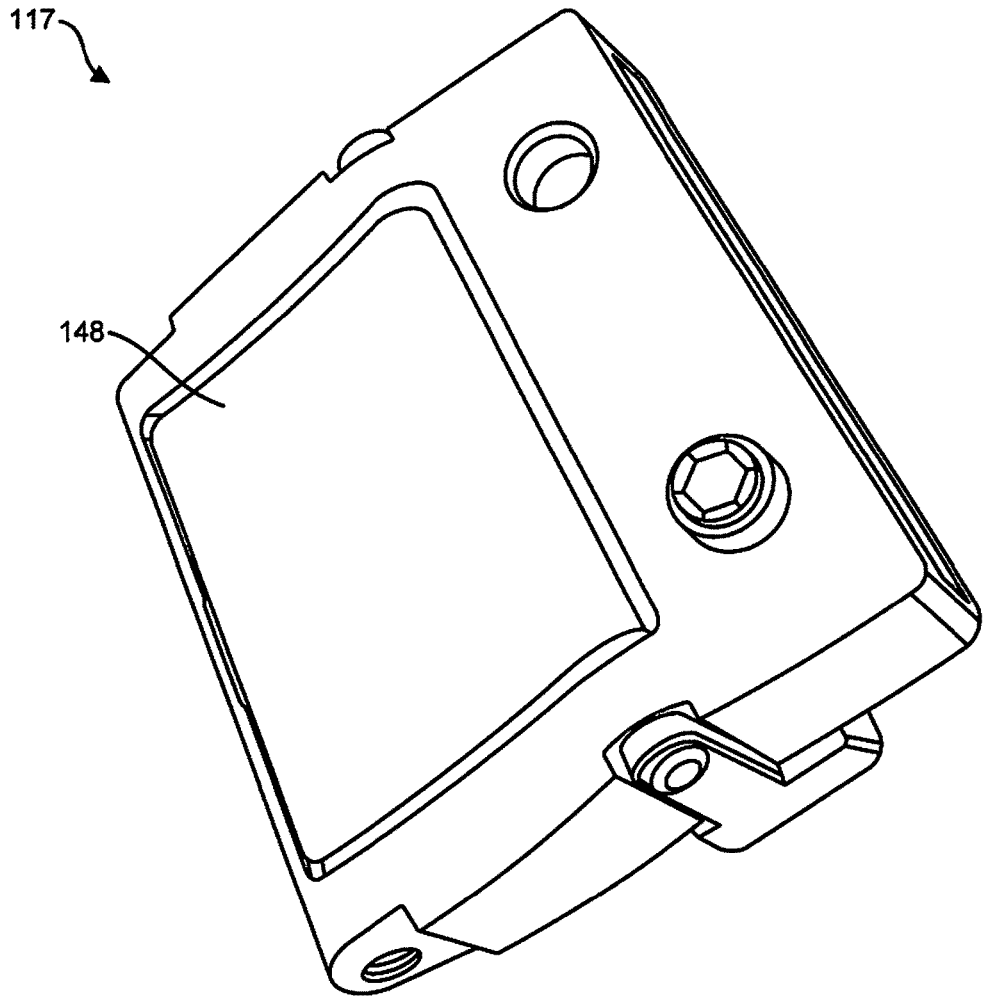

A clamp door 148 is movably attached to the body 600 such that the door 148 can rotate between an open position (as shown in FIGS. 7-10) and a closed position (as shown in FIG. 10). As shown in FIG. 9, a set of retainer members, such as teeth 705 (FIG. 9), are positioned on an inner surface of the door 148 such that the teeth 705 engage a belt when the belt is positioned in the passageway so as to grip against or otherwise retain the belt in position. That is, the teeth press against or partially insert into the belt so as to grip or otherwise retain the belt in position within the clamp mechanism.

The screw(s) 615 can be tightened so that the ends of the screws 615 press against, insert into, or otherwise engage the belt when the belt is positioned in the passageway to retain the belt in position within the clamp mechanism 117. In this manner, the screw(s) 615 act as an additional retaining feature (in addition to the teeth 705) that increases the likelihood that the clamp mechanism will retain the belt within the buckle even when external forces are applied to the belt that might otherwise release the belt from the buckle.

In a method of manufacture, one or more of the components of the buckle are provided. The components are assembled in a manner that forms the shape of the buckle. One or more of the components can be drilled or tapped with appropriately sized holes, openings, or passageways that are sized and shaped to receive a corresponding screw. One or more of the holes, openings, or passageways can be threaded. An appropriately sized screw can then be inserted into a corresponding opening and threadedly retained in the opening to secure one or more components of the buckle to other components of the buckle. The clamp mechanism is formed and can be attached to the other components to form the buckle.

With reference now to the side view of FIG. 2, the body 207 of the buckle 110 is shaped such that a cavity or cut out 215 is formed on the side of the body 207. The cut out 215 is such that a region of the body 207 is thinner relative to an adjacent region, with the region being thinner along a dimension or direction normal to a wearer's body when the belt is worn around the wearer's waist. That is, the direction is a direction along the line of sight of a person that is facing the wearer and looking toward the front side of the wearer. In this manner, the body of the buckle is so dimensioned so that the wearer's pants button does not contribute to or cause the belt buckle to protrude any further outward from the wearer's pants if the wearer's pants did not have a button in the region of the buckle when the buckle is worn. The cut out is so dimensioned relative to a wearer's pant button so that the pant button fits within the cut out.

The cut out 215 is sized and shaped to form a gap in the body of the buckle in which the wearer's pants button can be positioned when the belt is worn. In this manner, the buckle can be positioned atop the button without the button contributing to the overall size of the buckle or pushing the buckle outward away from the user's body. The button therefore does not interfere with the belt buckle and does not result in the buckle being pushed outward from the user's body when the belt is worn around the waist. FIG. 2 shows one side view of the belt buckle. It should be appreciated that the opposite side view of the belt buckle also has a cutout 215 similar to the cutout 215 shown in FIG. 2. The cut out 215 is located along the length of the belt buckle with the length being the longitudinal direction of the belt member. The cutout 215 extends along only a portion of the entire length of the belt buckle such that the belt buckle has a thickness that is greater where the cavity or cutout 215 is not located relative to whether cavity or cutout 215 is located.

While this specification contains many specifics, these should not be construed as limitations on the scope of an invention that is claimed or of what may be claimed, but rather as descriptions of features specific to particular embodiments. Certain features that are described in this specification in the context of separate embodiments can also be implemented in combination in a single embodiment. Conversely, various features that are described in the context of a single embodiment can also be implemented in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or a variation of a sub-combination. Similarly, while operations are depicted in the drawings in a particular order, this should not be understood as requiring that such operations be performed in the particular order shown or in sequential order, or that all illustrated operations be performed, to achieve desirable results. Only a few examples and implementations are disclosed. Variations, modifications and enhancements to the described examples and implementations and other implementations may be made based on what is disclosed.

Although embodiments of various methods and devices are described herein in detail with reference to certain versions, it should be appreciated that other versions, embodiments, methods of use, and combinations thereof are also possible. Therefore, the spirit and scope of the appended claims should not be limited to the description of the embodiments contained herein.

The invention claimed is:

1. A belt system, comprising:

an elongate belt member comprising a first end, a second end and an inner surface near the second end, wherein the inner surface has a series of teeth;

a buckle system removably attached on a first end of the belt member, including a ratchet assembly that engages the series of teeth on the belt member, the buckle including a clamp mechanism that clamps onto the first end of the belt member to secure the belt member to the buckle system, the buckle system further including at least one set screw that further secures the belt member to the buckle system and a door on the buckle that opens and closes to reveal a hidden compartment wherein the hidden compartment is sized and shaped to contain at least one of a ball marker and a divot repair tool.

2. The belt system of claim 1, wherein the clamp mechanism includes a door that rotates between an open position and a closed position, where the door engages the belt member when the door is in the closed position.

3. The belt system of claim 2, wherein the door has an inner surface with at least one tooth that engages the belt member when the door is in the closed position.

4. The belt system of claim 1, wherein the buckle system defines a passageway in which the belt member can be positioned, and wherein the at least one set screw is positioned within a threaded bore that communicates with the passageway such that a distal end of the set screw engages the belt member when positioned in the passageway.

5. The belt system of claim 1, wherein the at least one set screw is an Allen screw.

6. The belt system of claim 1, wherein the at least one set screw comprises multiple set screws.

7. The belt system as in claim 1, wherein the buckle system includes a main body and a bridge that forms an opening through which the second end of the belt can be threaded when worn by a user.

8. A belt system, comprising:

an elongate belt member comprising a first end, a second end and an inner surface near the second end, wherein the inner surface has a series of teeth;

a buckle system removably attached on a first end of the belt member, including a ratchet assembly that engages the series of teeth on the belt member, the buckle including a clamp mechanism that clamps onto the first end of the belt member to secure the belt member to the buckle system, the buckle system further including at least one set screw that further secures the belt member to the buckle system.

9. The belt system of claim 8, wherein the clamp mechanism includes a door that rotates between an open position and a closed position, where the door engages the belt member when the door is in the closed position.

10. The belt system of claim 9, wherein the door has an inner surface with at least one tooth that engages the belt member when the door is in the closed position.

11. The belt system of claim 8, wherein the buckle system defines a passageway in which the belt member can be positioned, and wherein the at least one set screw is positioned within a threaded bore that communicates with the passageway such that a distal end of the set screw engages the belt member when positioned in the passageway.

12. The belt system of claim 8, wherein the at least one set screw is an Allen screw.

13. The belt system of claim 8, wherein the at least one set screw comprises multiple set screws.

14. The belt system as in claim 8, wherein the buckle system includes a main body and a bridge that forms an opening through which the second end of the belt can be threaded when worn by a user.

* * * * *